US006523903B1

(12) United States Patent
Rabenhorst

(10) Patent No.: US 6,523,903 B1
(45) Date of Patent: Feb. 25, 2003

(54) ADJUSTABLE ARMREST FOR ATTACHMENT TO AN ARMCHAIR

(75) Inventor: Alfred Rabenhorst, Weslaco, TX (US)

(73) Assignees: Joseph Milo Rabenhorst, Mapleton, MN (US); Jean Rabenhorst, Weslaco, TX (US)

( * ) Notice: Subject to any disclaimer, the term of this patent is extended or adjusted under 35 U.S.C. 154(b) by 0 days.

(21) Appl. No.: 10/015,294

(22) Filed: Dec. 12, 2001

(51) Int. Cl.[7] ..... A47C 7/54
(52) U.S. Cl. ..... 297/411.32; 297/162
(58) Field of Search ..... 297/463.2, 411.2, 297/411.23, 411.26, 411.32, 411.33, 411.34, 411.38, 135, 170, 173, 162; 29/428

(56) References Cited

U.S. PATENT DOCUMENTS

| | | | | |
|---|---|---|---|---|
| 1,670,603 | A | | 5/1928 | Weeks |
| 1,925,246 | A | | 9/1933 | Hayes |
| 2,592,702 | A | * | 4/1952 | Sprung |
| 2,710,051 | A | * | 6/1955 | Greenberg |
| 2,725,095 | A | * | 11/1955 | Rodefeld |
| 3,206,249 | A | * | 9/1965 | Gateley |
| 3,843,196 | A | * | 10/1974 | Burke |
| 3,865,434 | A | * | 2/1975 | Sully |
| 5,564,779 | A | * | 10/1996 | Tolbert et al. |
| 5,590,934 | A | | 1/1997 | Gibbs ..... 297/411.38 |
| 5,823,976 | A | * | 10/1998 | Cain et al. |
| 5,864,902 | A | * | 2/1999 | Rogers |
| 5,873,624 | A | | 2/1999 | Simpson ..... 297/45 |
| 5,893,607 | A | * | 4/1999 | Trimnell |
| 6,341,821 | B1 | * | 1/2002 | Rousseau |

* cited by examiner

*Primary Examiner*—Milton Nelson, Jr.
(74) *Attorney, Agent, or Firm*—Goldstein & Lavas, P.C.

(57) ABSTRACT

An adjustable armrest assembly for attachment to an armchair. The armrest assembly includes a flat work surface, an upper horizontal support member, and a lower horizontal support member. A vertical support member extends diagonally between the lower horizontal support member and the underside of the work surface, at the outer edge of the surface. The vertical support member has a mid point crease. A mid point hinge is attached to the vertical support member at the mid point crease. The vertical support member further comprises a top hinge extending between the top edge of the vertical support and the underside of the work surface. The bottom edge of the vertical support member rests on the front surface of the lower horizontal support member, and is wedged between the member and a block attached to the front surface of the member.

7 Claims, 3 Drawing Sheets

ADJUSTABLE ARMREST FOR ATTACHMENT TO AN ARMCHAIR

BACKGROUND OF THE INVENTION

The invention relates to an adjustable chair armrest. In particular, the invention is an armrest assembly that is attached to a standard armchair, said assembly including a flat work surface that is collapsible for convenient storage along with the armchair.

With the increased popularity of computers, it is common to find a personal computer in many homes. An average person typically spends hours everyday working with a computer. Since it is often necessary to employ a computer mouse and mouse pad with the computer, a user often finds himself or herself sitting in an uncomfortable upright position for hours. Space constraints normally dictate that the mouse and mouse pad be kept on the side of the computer, on a desk surface. mouse pad be kept on the side of the computer, on a desk surface.

Thus, there exists a need for a device which may enable a computer user to conveniently and comfortably operate a computer mouse in conjunction with a computer. Such a device would preferably be attached to the side of a standard armchair, whereby a flat work surface is provided for added space to hold a mouse pad, as well as providing additional armrest space for use while working.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved adjustable armchair armrest for attachment to a standard armchair. As such, the general purpose of the present invention, which will be described subsequently in greater detail, is to provide a new and improved adjustable armchair armrest which has all the advantages of the prior art and none of the disadvantages.

To attain this, the present invention essentially comprises an adjustable armrest assembly for attachment to an armchair. The armrest assembly includes a flat work surface, an upper horizontal support member, and a lower horizontal support member. A vertical support member extends diagonally between the lower horizontal support member and the underside of the work surface, at the outer edge of the surface. The vertical support member has a mid point crease. A mid point hinge is attached to the vertical support member at the mid point crease. The vertical support member further comprises a top hinge extending between the top edge of the vertical support and the underside of the work surface. The bottom edge of the vertical support member rests on the front surface of the lower horizontal support member, and is wedged between the member and a block attached to the front surface of the member.

It is an object of the invention to produce an adjustable armchair armrest that provides additional work space, as well as a resting surface for a user's arm. Accordingly, the armrest assembly includes a flat work surface that is adequately supported to receive pressure from an arm, as well as provide space for work instruments, namely a computer mouse and a mouse pad.

It is a further object of the invention to produce an adjustable armchair armrest that is collapsible for easy storage. Accordingly, the armrest assembly may be collapsed in a manner so that the work surface extends vertically along the side of the armchair.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
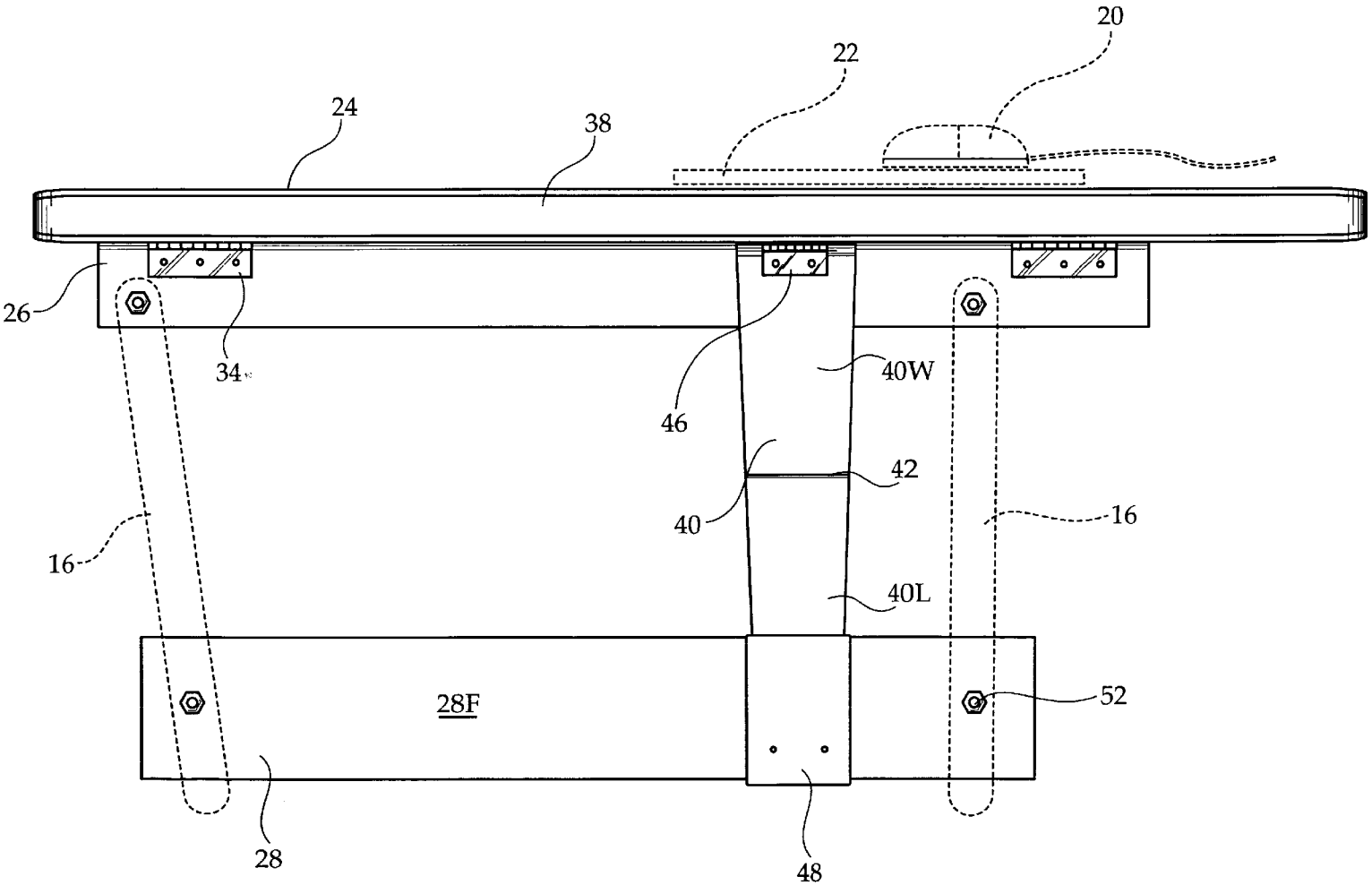
FIG. 1 is a front elevational view of an adjustable armrest for attachment to an armchair with the work surface extended horizontally, a mouse and mouse pad shown in broken lines.

10 armrest assembly
12 armchair
14 horizontal arm of armchair
16 vertical braces of armchair
18 seat of armchair
20 computer mouse
22 mouse pad
24 flat work surface
26 upper horizontal support member
28 lower horizontal support member
28F front surface of lower horizontal support member
30 underside of work surface
32 top surface of work surface
34 upper horizontal support member hinges
36 inner edge of work surface
38 outer edge of work surface
40 vertical support member of assembly
40U upper portion of vertical support member
40L lower portion of vertical support member
40T top edge of upper portion of vertical support member
40B bottom edge of bottom portion of vertical support member
42 mid point crease of vertical support member
44 mid point hinge of vertical support member

46 top hinge of vertical support member
48 block
50 bores
52 bolts

DETAILED DESCRIPTION OF THE PREFERRED EMBODIMENTS

FIG. 1 illustrates an adjustable armrest assembly 10 for attachment to an armchair 12. A standard armchair 12 has a horizontal arm 14, supported by two vertical braces 16 extending upward from a seat 18 of said armchair 12. The armrest assembly 10 is secured to the vertical braces 16 of the armchair 12 as will be described in detail hereinafter. The armrest assembly 10 allows a user a larger work surface area, which may be employed for operating a computer mouse 20 on a mouse pad 22.

The armrest assembly 10 substantially comprises a flat work surface 24, an upper horizontal support member 26 and a lower horizontal support member 28, said lower support member 28 being substantially parallel to the upper support member 26. The flat work surface 24 has a top surface 32, on which items such as a mouse 30 and mouse pad 22 may rest, an underside 30, an inner edge 36, and an outer edge 38. When the armrest assembly 10 is properly attached to the armchair 12, the inner edge 36 of the work surface 24 is positioned adjacent to said armchair 12, while the outer edge 38 is positioned a distance away from the armchair 12.

Figure 2:
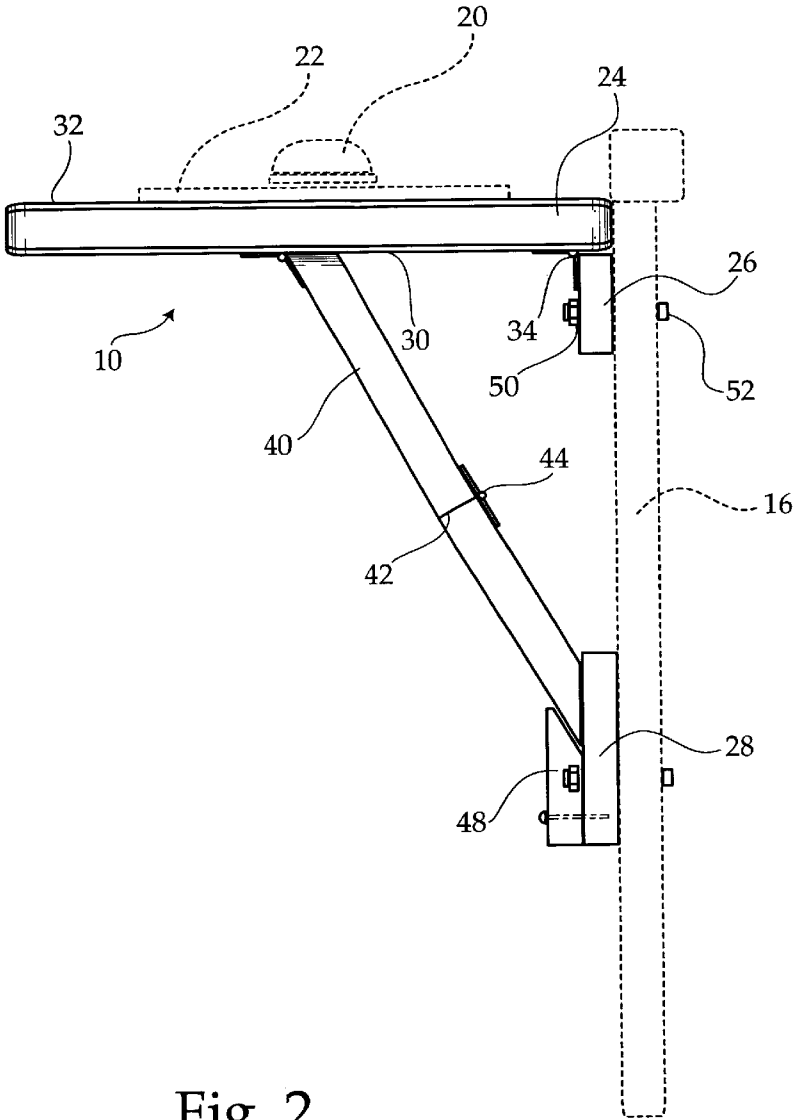
FIG. 2 is a side elevational view of the adjustable armrest with the work surface extended horizontally, wherein a mouse, a mouse pad, and an armchair are shown in broken lines.
Figure 5:
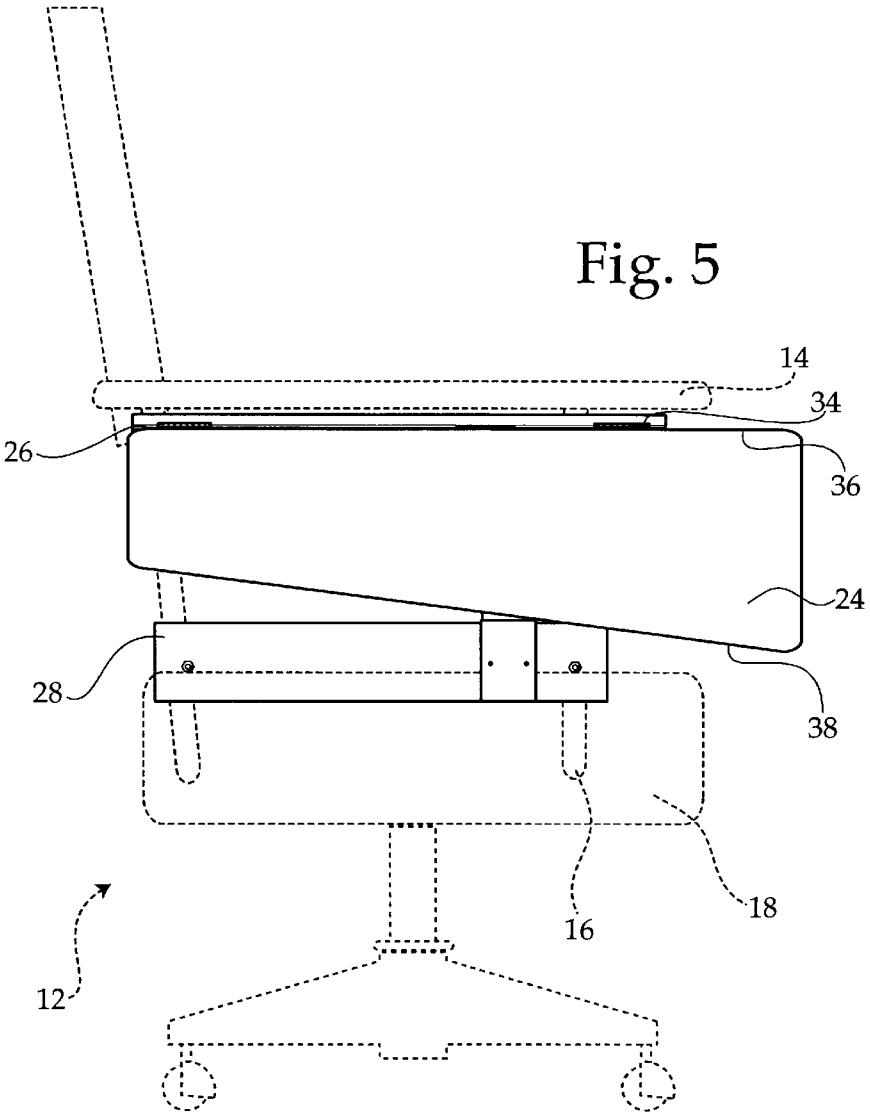
FIG. 5 is a front elevational view of the adjustable armrest with the work surface extended vertically, wherein an armchair is shown in broken lines.
Figure 4:
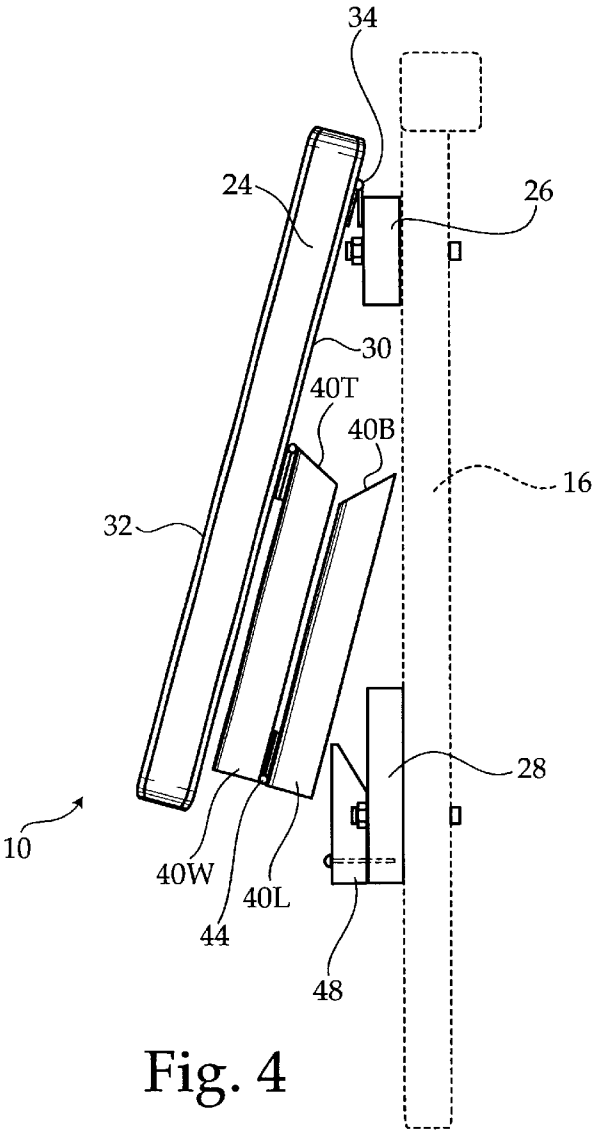
FIG. 4 is a side elevational view of the adjustable armrest with the work surface collapsed vertically, wherein an armchair is shown in broken lines.

The upper support member 26 is attached to the underside 30 of the work surface 24, at the inner edge 36 of said work surface 24, by means of a plurality of upper support member hinges 34. The hinges 34 allow the work surface 24 to pivot about said hinges 34 into a vertical position, as illustrated in FIG. 4, or a horizontal position, as illustrated in FIG. 2.

Figure 3:
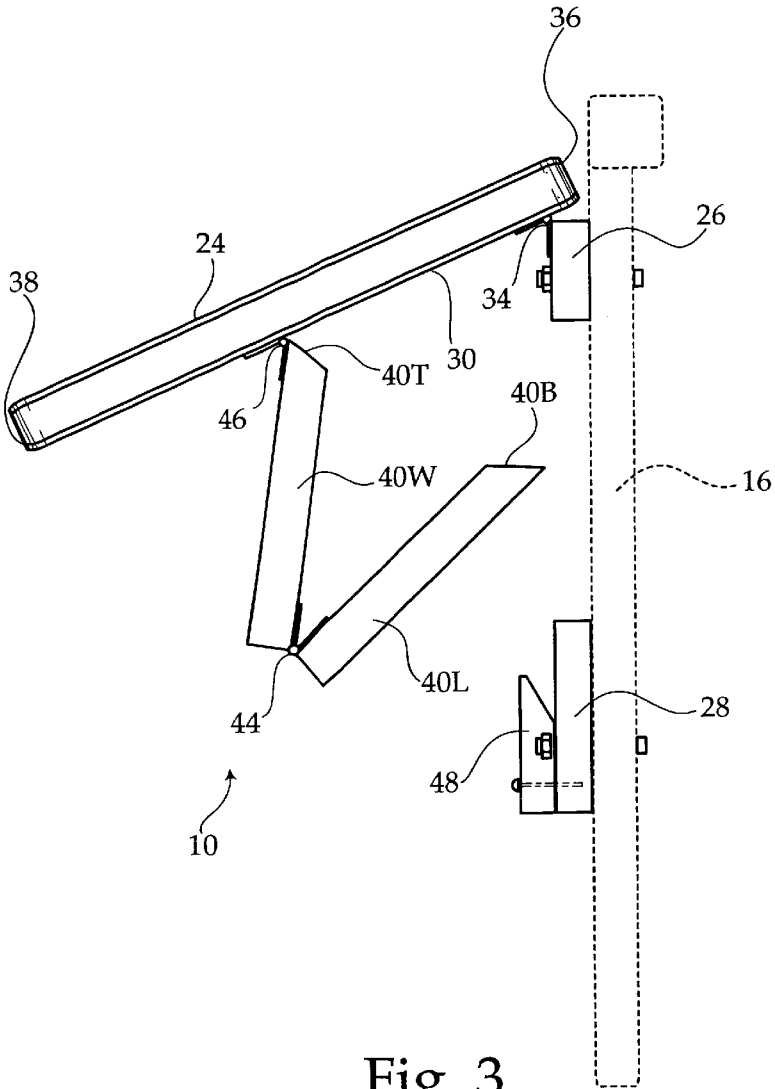
FIG. 3 is a side elevational view of the adjustable armrest with the work surface partially collapsed, wherein the armchair is shown in broken lines.

A vertical support member 40 extends diagonally between the lower horizontal support member 28 and the underside 30 of the work surface 24, at the outer edge 38 of said work surface 24. This vertical support member 40 serves as a brace for the work surface 24 when in the horizontal position. The vertical support member 40 has a mid point crease 42 at which point the member 40 is split into an upper portion 40U, having a top edge 40T, and a lower portion 40L, having a bottom edge 40B. A mid point hinge 44 is attached to the upper portion 40U and the lower portion 40L at the mid point crease. Besides connecting the upper portion 40U to the lower portion 40L, this hinge 44 allows the vertical support member 40 to collapse, as illustrated in FIG. 3. The vertical support member further comprises a top hinge 46, said hinge 46 extending between the upper portion top edge 40T and the underside 30 of the work surface 24.

The bottom edge 40B of the lower portion 40L of the vertical support member 40 rests on a front surface 28F of the lower horizontal support member 28, and is wedged between said member 28 and a block 48 attached to the front surface 28F of the member 28. This configuration allows the lower portion 40L of the vertical support member 40 to slip in and out of the space between the block 48 and the lower horizontal support member 28.

The upper horizontal support member 26 and the lower horizontal support member 28 both have a set of bores 50 positioned on the ends of the members 26, 28. When the armrest assembly 10 is properly positioned on the side of the armchair 12, the bores 50 are aligned with the corresponding armchair vertical brace bores. A bolt 52 extends through the bores 50 of the support members and selectively engages with the bores of the armchair vertical braces 16, thereby securing the armrest assembly 10 in place on the armchair 12.

In use, the armrest assembly 10 is placed on the side of an armchair 12, in such a manner that the inner edge 36 of the work surface 24 is adjacent to the vertical braces 16 of the armchair 12. The bores 50 of the upper and lower horizontal support members 26, 28 are aligned with the bores in the armchair vertical braces 16. Bolts 52 are inserted through the bores 50, thereby attaching the assembly 10 to the armchair 12. In order to utilize the work surface 24, said surface 24 is lifted upward into a horizontal position, and the vertical support member 40 is extended diagonally between the work surface 24 and the lower support member 28. The bottom edge 40B of the vertical support member 40 is wedged between the lower support member 28 and the block 48. In this position, the work surface 24 is sufficiently supported and a user may utilize said surface 24 as a work area and/or an armrest.

In order to collapse the work surface 24 of the assembly 10 in order to minimize the amount of space occupied, the bottom edge 40B of the vertical support member 40 is removed from the space between the lower support member 28 and the block 48. The vertical support member 40 is then folded at the mid point crease 42, thereby allowing the work surface 24 to be collapsed downward into a vertical position.

In conclusion, herein is presented an adjustable chair armrest. The invention is illustrated by example in the drawing figures, and throughout the written description. It should be understood that numerous variations are possible, while adhering to the inventive concept. Such variations are contemplated as being a part of the present invention.

What is claimed is:

1. An adjustable chair armrest assembly for attachment to an armchair, the armchair having a horizontal arm, a seat, and a pair of vertical braces having bores at each end thereof, extending between the arm and the seat, the assembly comprising:

a flat work surface having an underside, an inner edge, and an outer edge, wherein upon attachment of the work surface to the armchair the inner edge of the surface is positionable adjacent to the armchair;

an upper horizontal support member attached by at least one upper support hinge to the underside of the work surface, at the inner edge of said surface, the at least one hinge extending between the support member and the underside of the work surface, wherein the at least one hinge allows the work surface to pivot downward about the hinge, the upper support member capable of selectively engaging the pair of vertical armchair braces;

a lower horizontal support member having a front surface, the support member capable of selectively engaging the pair of vertical armchair braces at a point below the upper horizontal support member; and a vertical support member extending between the underside of the work surface and the lower horizontal support member.

2. The adjustable chair armrest assembly as recited in claim 1, wherein the upper support member and the lower support member each has a bore on each end thereof, wherein a bolt is inserted through each bore, said bolt capable of being selectively engaging the corresponding bore on the vertical armchair braces, thereby attaching the armrest to the armchair.

3. The adjustable chair armrest assembly as recited in claim 1, further comprising a block selectively fastened to the front surface of the lower horizontal support member, defining a space between the block and the support member.

4. The adjustable chair armrest assembly as recited in claim 3, wherein the vertical support member has a mid point crease, said crease separating the support member into an upper portion, having a top edge, and a lower portion, having a bottom edge, wherein a mid point hinge is attached to the upper portion and the lower portion to allow the vertical support member to fold about the hinge, and a top hinge attaches the top edge of the upper portion to the underside of the work surface.

5. The adjustable chair armrest assembly as recited in claim 4, wherein the bottom edge of the vertical support member is wedged within the space created between the block and the lower support member.

6. A method of utilizing an adjustable armchair armrest, on an armchair, using the armrest comprising a flat work surface having an underside, an upper horizontal support member having at least one upper support hinge extending between the support member and the underside of the work surface, a lower horizontal support member having a front surface and a block attached to the front surface of the lower horizontal support, and a vertical support member extending between the underside of the work surface to the front surface of the lower support member, the vertical support member having a mid point crease dividing the support member into an upper portion and a lower portion, wherein a mid point hinge is positioned at the mid point crease and extends between the upper portion and the lower portion, comprising the steps of:

attaching the armrest to the armchair;

extending the work surface horizontally by pivoting said surface about the at least one upper support hinge;

unfolding the vertical support member by pivoting the upper portion and the lower portion about the mid point hinge;

extending the vertical support member diagonally from the work surface to the lower horizontal support member; and wedging the bottom edge of the vertical support member within a space created between the lower support member and the block.

7. The method of utilizing an adjustable armchair armrest as recited in claim 6, wherein the armchair has a pair of vertical braces extending between a seat and a horizontal armrest, each brace having a pair of bores at each end of said braces, and the upper and lower horizontal support members each have a bore at each end of said members, wherein the step of attaching the armrest to the armchair further comprising the steps of:

aligning the upper horizontal support member and the lower horizontal support member with the vertical braces of the armchair; and engaging a bolt through the bores of the upper and lower support members, and through the corresponding bores of the vertical braces.

* * * * *